US008303169B2

(12) United States Patent
Sabatini et al.

(10) Patent No.: US 8,303,169 B2
(45) Date of Patent: Nov. 6, 2012

(54) COMFORT WATCH

(75) Inventors: Mario Sabatini, Branford, CT (US); John Houlihan, Branford, CT (US); Muhammad Saleh, Woodbridge, CT (US); Paul Myott, Woodbridge, CT (US)

(73) Assignee: Bulltoro Watch Company, LLC, Woodbridge, CT (US)

( * ) Notice: Subject to any disclaimer, the term of this patent is extended or adjusted under 35 U.S.C. 154(b) by 125 days.

(21) Appl. No.: 13/011,424

(22) Filed: Jan. 21, 2011

(65) Prior Publication Data

US 2012/0188857 A1 Jul. 26, 2012

(51) Int. Cl.
*A44C 5/00* (2006.01)
*G04B 37/00* (2006.01)

(52) U.S. Cl. ..... 368/281; 368/313

(58) Field of Classification Search ..... 368/276, 368/281–283, 309–313
See application file for complete search history.

(56) References Cited

U.S. PATENT DOCUMENTS

| | | | | |
|---|---|---|---|---|
| 4,624,581 | A * | 11/1986 | Mock et al. | 368/282 |
| 4,825,427 | A * | 4/1989 | Wollman | 368/282 |
| 5,206,841 | A * | 4/1993 | Boucheron | 368/276 |
| 5,638,342 | A * | 6/1997 | Kartsotis et al. | 368/282 |
| 5,838,642 | A * | 11/1998 | Tully | 368/282 |
| 7,114,845 | B2 * | 10/2006 | Wilson | 368/281 |
| 2010/0135128 | A1 * | 6/2010 | Penula | 368/281 |

* cited by examiner

*Primary Examiner* — Sean Kayes
(74) *Attorney, Agent, or Firm* — Michael A. Blake

(57) ABSTRACT

A watch comprising: a watch bezel; a watch case in communication with the watch bezel, the watch case comprising several vents which are generally configured to allow air to flow through the vents.

14 Claims, 5 Drawing Sheets

COMFORT WATCH

TECHNICAL FIELD

This invention relates generally to watches, and more particularly to a watch with vents and bosses to improve comfort for the wearer of a watch.

BACKGROUND

A conventional wrist-worn timepiece (i.e., a watch) may be structured to perform both aesthetically and functionally during a variety of activities. Dress watches, for example, are designed to have a fashionable appearance appropriate for business or social gatherings. Diving watches are designed to be particularly durable and water-resistant in order to withstand the high-pressure environments often encountered by scuba divers. In addition, sport watches are designed to be lightweight and worn by athletes during athletic training or competitions.

The components of a conventional watch generally include a timing element, a case, and a wristband. The timing element is located within the case and primarily functions to display time in either an analog or digital format. The case protects the timing element and often includes a transparent crystal for viewing the time or other information displayed on the timing element. The wristband extends from opposite sides of the case and secures the case and timing element to a wrist of an individual.

Although a majority of watches include a timing element, case, and wristband, modern watch designs include many variations upon these components. For example, the timing element may incorporate mechanical, electrical, or a combination of mechanical and electrical components. In addition to displaying time, the timing element may function as a chronograph, count-down timer, alarm, lap counter, calculator, thermometer, heart-rate monitor, altimeter, or global positioning system device, for example. Materials forming the case may be a polymer or a metal, and the crystal may be formed from a polymer, glass, or sapphire crystal, for example. Furthermore, the wristband may be formed from a metal, a polymer, or leather, and the wristband may have a clasp that secures the watch to the wrist or an open, bracelet-type configuration.

Some watches are known to cause discomfort to the user, especially at the interface between the watch case and the skin. The discomfort may be due to a variety of factors, including but not limited to prolonged contact of the skin with the watch; sweat, dirt, etc. build up between the skin and the watch; or wearing the watch while exercising or during hot or humid conditions.

Thus there is a need for a watch case that overcomes the above listed and other disadvantages.

SUMMARY OF THE INVENTION

The disclosed invention relates to a watch comprising: a watch bezel; a watch case in communication with the watch bezel, the watch case comprising: a left side; a right side; a crown side; a non-crown-side; a bottom surface; a top surface; a left watch band connecting member, the left watch band connecting member comprising: a left base; a plurality of teeth extending from the left base; a first left side vent located on the left watch band connecting member, the first left side vent comprising: a left side first vent opening located on the left watch band connecting member and located generally on the top surface; a left side second vent opening located on the left watch band connecting member and located generally on the bottom surface and in fluid communication with the left side first vent opening; a right watch band connecting member, the first right watch band connecting member comprising: a right base; a plurality of teeth extending from the right base; a first right side vent located on the right watch band connecting member, the right side vent comprising: a right side first vent opening located on the right watch band connecting member and located generally on the top surface; a right side second vent opening located on the right watch band connecting member and located generally on the bottom surface and in fluid communication with the right side first vent opening; a first extending member, extending generally parallel to the top surface, and extending from the crown side of the watch case; a first crown side vent, located in the first extending member, the first crown side vent comprising: a first vent opening located in the first extending member and generally facing a direction that is parallel to the top surface; a second vent opening located in the first extending member, and located generally on the bottom surface of the watch, the second vent opening is in fluid communication with the first vent opening; a generally cylindrically shaped member located on the non-crown side of the watch; a first vent located on the generally cylindrically shaped member, the first vent comprising: a first set of vent openings angularly spaced about the generally cylindrically shaped member, where the first sent of vent openings are generally on the upper half of the generally cylindrically shaped member; a first-vent second opening located on the generally cylindrically shaped member and generally facing in the same direction as the bottom surface of the watch, and is in fluid communication with the first sent of vent openings.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
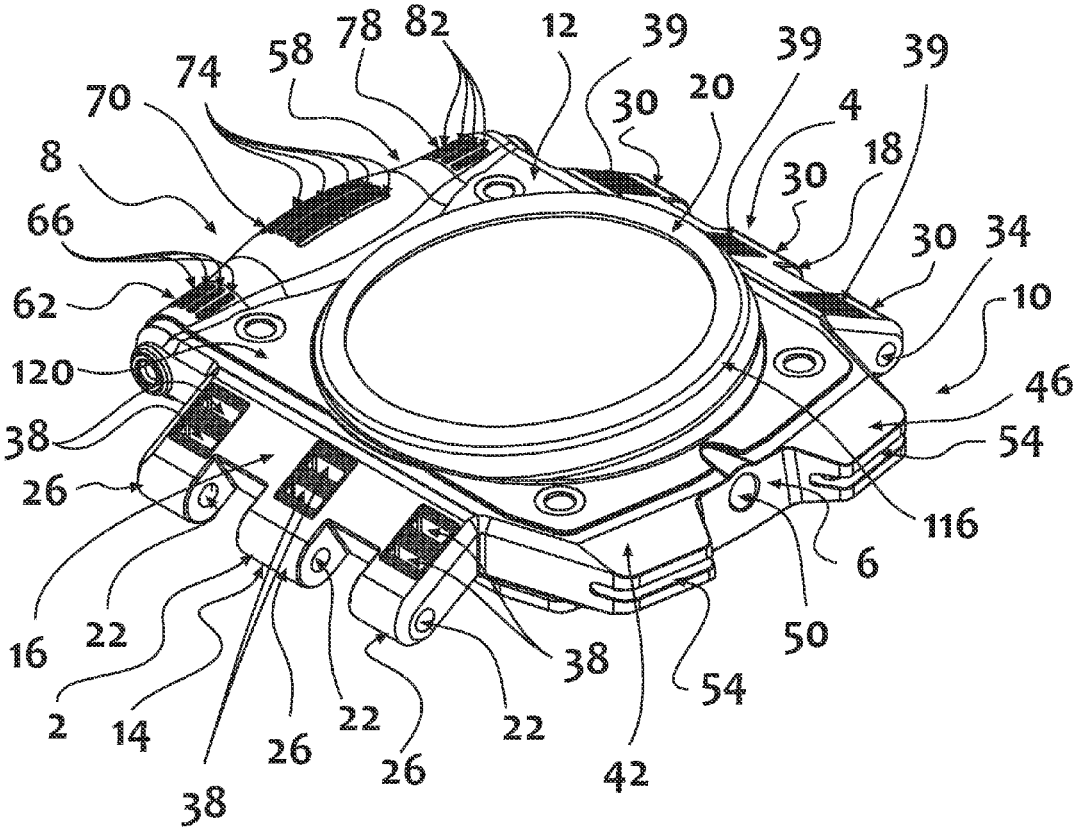
FIG. 1 is a top perspective view of the watch.

FIG. 1 shows a perspective view of a watch 10. The watch movement and crown setting device are not shown for simplicity, but the watch case 12 and watch bezel 116 are shown. In one embodiment, the watch bezel 116 is set at an angle with respect to the top surface of the watch case 136, which in this embodiment is the watch cover plate 132. However, in other embodiments, the watch 10 may have a bezel that is generally parallel to the top surface of the watch case 136 and/or watch cover plate 132. The watch has generally four sides: a left side 2, right side 4, crown side 6, and non-crown side 8. Also, the watch band is not shown in this view, but the left watch band connecting member 14 and the right watch band connecting member 18 are shown. The left watch band connecting member 14 comprises a left base 16, a set of left three teeth 26 that extend from the left base, and a left pin hole 22 that extends through each of the left three teeth 26. Thus a watch band with five teeth (or two) will mesh with the three teeth 26, and be held in place be inserting a pin through pin hole 22, and a co-linear pin hole in the five (or two) teeth of the watch band.

A similar means is used to attach the other end of a watch band to the right watch band connecting member 18, where the right watch band connecting member 18 comprises a right base 20, a set of right three teeth 30 extending from the base 20, and a right co-linear pin hole 34 extends through each of the right three teeth. One of ordinary skill in the art will recognize that the number of teeth that comprising the watch band connecting members 14, 18 can vary from one, two, three, or more. Located in the watch case 12 is a plurality of vents. Each vent has at least a first opening and a second opening, where air can travel through a vent from the first opening to the second opening and vice versa. These vents tend to keep a users skin and wrist more comfortable due the ability of fresh air to reach the skin and wrist in the area adjacent to the watch and watch band.

The left watch band connecting member 14 has several vents. In FIG. 1, the left side first vent openings 38 are visible. In one embodiment the left side first vent openings 38 may be located on the left base, and extend slightly into the teeth 26. Six (6) left side first vent openings 38 are shown on the left watch band connecting member 14; however, fewer vents or more vents may be used. Similarly the right watch band connecting member 18 has several vents. In one embodiment the right side first vent openings 39 may be located on the right base, and extend slightly into the teeth 30. Six (6) right side first vent openings 39 are shown on the right watch band connecting member 18; however, fewer vents or more vents may be used. In an embodiment, the first vent openings 38, 39 may have a width about 2.0 mm to about 5.0 mm, and a height of about 5 mm to about 2.0 mm.

The vent openings 38, 39 may face in a direction that is generally perpendicular to the watch cover plate 132, or in a direction that is at an acute angle with respect to the watch cover plate 132 and or top surface of the watch case 136. The vent openings 38, 39 may be generally on the top surface 120 of the watch.

On the crown side of the watch, there are shown a first extending member 42, and a second extending member 46, on either side of a crown receptacle 50. These extending members extend a distance D from the watch case, see FIG. 3. D may range about 2.0 mm to about 10.0 mm. The extending members may have a crown side vent. In this view the crown side first vent openings 54 are visible. In one embodiment the crown side first vent opening may have a width of about 5.0 mm to about 12.0 mm, and a height of about 0.5 mm to about 2.0 mm. In one embodiment, the vent openings 54 may be oriented to face in a direction generally parallel to the watch cover plate 132 and or top surface of the watch case 136.

Figure 5:
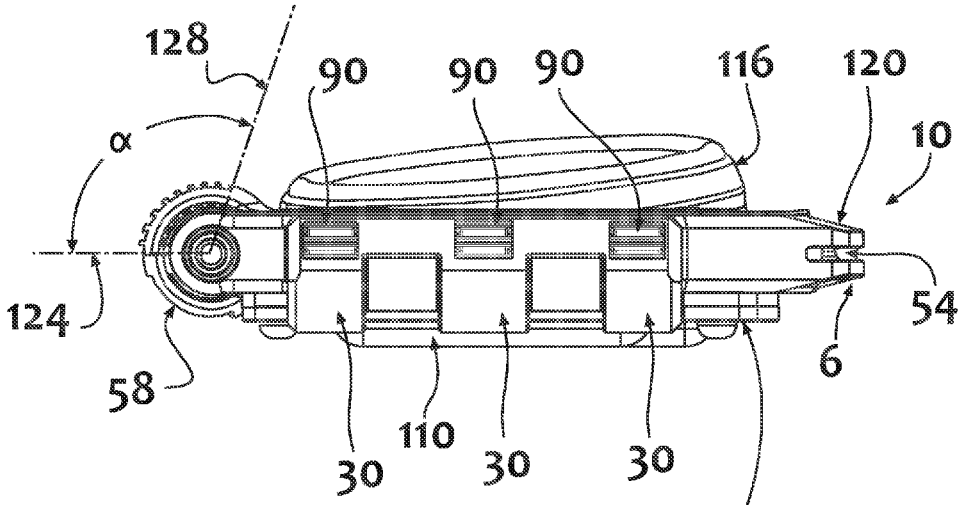
FIG. 5 is a side view of the watch.

A generally cylindrically shaped member 58 is located on the non-crown side of the watch 10. The generally cylindrically shaped member 58 may have 2 or more radii throughout the length of the member 58. The generally cylindrically shaped member 58 may have one or more vents. In this embodiment, the generally cylindrically shaped member 58 comprises three vents. The first vent 62, comprises a first set of vent openings 66. These first sent of vent openings 66 are angularly spaced about the generally cylindrically shaped member 58 along a portion of the length of the generally cylindrically shaped member 58. Likewise, a second vent 70, comprises a second set of vent openings 74. These second sent of vent openings 74 are angularly spaced about the generally cylindrically shaped member 58 along a portion of the length of the generally cylindrically shaped member 58. In addition, a third vent 78, comprises a third set of vent openings 82. These third set of vent openings 82 are angularly spaced about the generally cylindrically shaped member 58 along a portion of the length of the generally cylindrically shaped member 58. The vent openings 66, 74, 82 may have a width of about 2.0 mm to about 15.0 mm and a height of about 0.5 mm to about 2.0 mm. The first set of vent openings 66; second set of vent openings 74; and third set of vent openings 82 may be angularly spaced about the generally cylindrically shaped member 58 along an angle $\alpha$ as shown in FIG. 5. In one embodiment, angle $\alpha$ may be the angle between a first imaginary line 124 through the center of the generally cylindrically shaped member 58 and parallel to the top surface of the watch case 136, and a second imaginary line 128 through the center of the generally cylindrically shaped member 58 and extending in a direction that is generally up and away form the top surface of the watch 10. In one embodiment the angle $\alpha$ may be about 105°, but may range from 45° to 180°. In still another embodiment, the first set of vent openings 66; second set of vent openings 74; and third set of vent openings 82 may be generally on the top half of the generally cylindrically shaped member 58, wherein the top half the generally cylindrically shaped member 58 is that half that is above the line 124.

Figure 2:
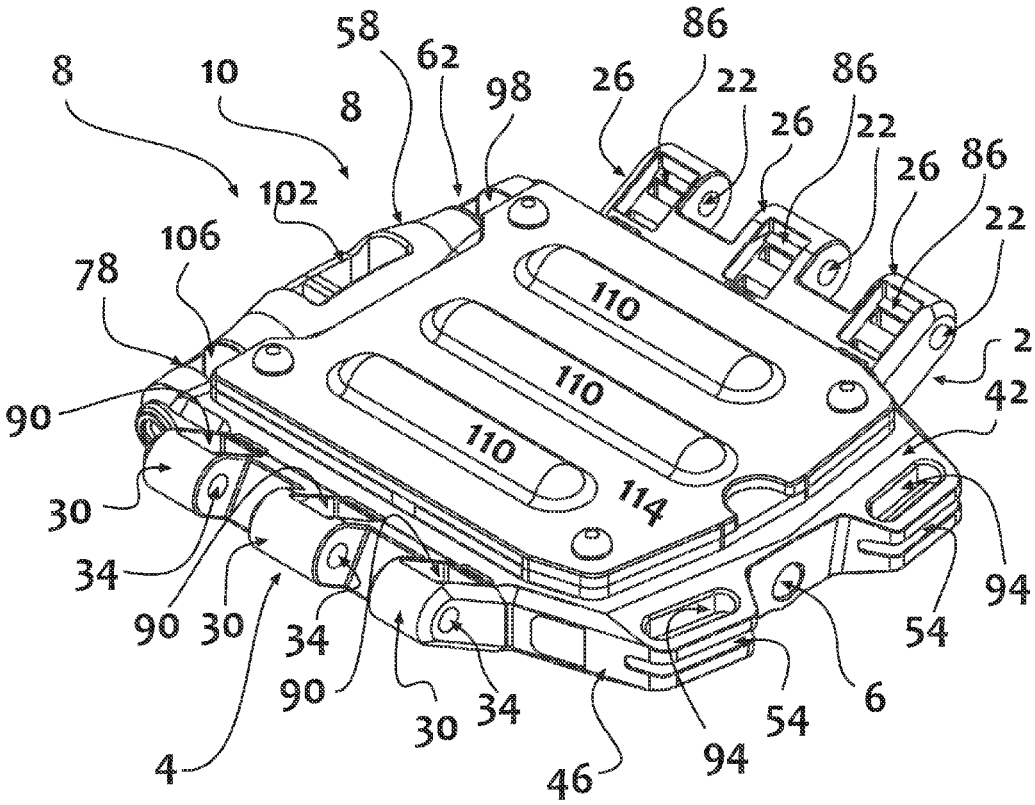
FIG. 2 is a bottom perspective view of the watch.

FIG. 2 is a bottom perspective view of the disclosed watch 10. In this view, the left side second vent openings 86 are visible as are the right side second vent openings 90. In this embodiment, each of the left side second vent openings 86, are associated with two of the left side first vent openings 38 on the same tooth 26, in that each left side second vent opening is fluid communication with the two left side first vent openings 38. One advantage of having two vent openings 38 on the upper side of the watch, is to prevent debris and other materials from falling into the vent, because the two vent openings 38 may be smaller than one single larger vent opening. On the other hand, there is little likelihood of debris falling into the underside vent openings 86 on the underside of the watch 10, hence a single and larger vent opening may be used. Similarly, in this embodiment, each of the right side second vent openings 90, are associated with two of the right side first vent openings 39 on the same tooth 30, in that they are in fluid communication with each other. The left side second vent openings 86 and right side second vent openings 90 may have a width of about 2.0 mm to about 5.0 mm, and a height of about 1.0 mm to about 6.0 mm. The underside of the first extending member 42 and second extending member 46 are shown in FIG. 2. The first extending member 42, has a crown side second vent opening 94, that is in fluid communication with the crown side first vent opening 54 located on the first extending member 42. Similarly, the second extending member 46, also has a crown side second vent opening 94, that is in fluid communication with the crown side first vent opening 54 located on the second extending member 46. The a crown side second vent openings 94 may have a generally rounded rectangular shape, in one embodiment, and may have a length of about 2.0 mm to about 12.0 mm and a width of about 1.0 mm to about 5.0 mm. Of course, other shapes for the vent openings 94 may be used, such as, but not limited to oval, rectangular, triangular, and trapezoidal.

The underside of the generally cylindrically shaped member 58 can also be seen in FIG. 2. The first-vent second vent opening 98 is seen located on a first end of the generally cylindrically shaped member 58. The first vent 62 comprises a first set of openings 66 (seen in FIG. 1) and the first-vent second vent opening 98 (seen in FIG. 2). The first-vent second vent opening 98 is in fluid communication with the first set of openings 66. The first-vent second vent opening 98 may have a generally parallelogram shape. The first-vent second vent opening 98 may have a width of about 2.0 mm to about 6.0 mm and a height of about 1.0 mm to about 6.0 mm. The second-vent second vent opening 102 is seen located generally in between the first vent 62 and third vent 78 on the generally cylindrically shaped member 58. The second vent 70 comprises a second set of openings 74 (seen in FIG. 1) and the second-vent second vent opening 102 (seen in FIG. 2). The second-vent second vent opening 102 is in fluid communication with the second set of openings 74. The second-vent second vent opening 102 may have a generally parallelogram shape. The second-vent second vent opening 102 may have width of about 6.0 mm to about 12.0 mm and a height of about 1.0 mm to about 6.0 mm. The third-vent second vent opening 106 is seen located generally on a second end of the generally cylindrically shaped member 58. The third vent 78 comprises a third set of openings 82 (seen in FIG. 1) and the third-vent second vent opening 106 (seen in FIG. 2). The third-vent second vent opening 106 is in fluid communication with the third set of openings 82. The third-vent second vent opening 106 may have a generally parallelogram shape. The third-vent second vent opening 102 may have a width of about 2.0 mm to about 6.0 mm and a height of about 1.0 mm to about 6.0 mm.

In addition, the underside of the watch 10 shows a plurality of raised members 110 or bosses. These raised members 110 may be elongated members as shown. However, in other embodiments, the raised members may have a circular shape, oval shape, or rectangular shape. As shown, the raised members 110 are orthogonal to the watch band (not shown) of the watch, however in other embodiments, the raised members 110 may be parallel or at an angle to the watch band. The raised members 110 may extend about 1.0 mm to about 3.0 mm from the bottom surface 114 of the watch. The raised members may have a length of about 15.0 mm to about 35.0 mm and a width of about 3.0 mm to about 6.0 mm. The raised members 110 assist in allowing air flow between the watch and the wearer's skin, thus providing for greater comfort to the user.

Figure 3:
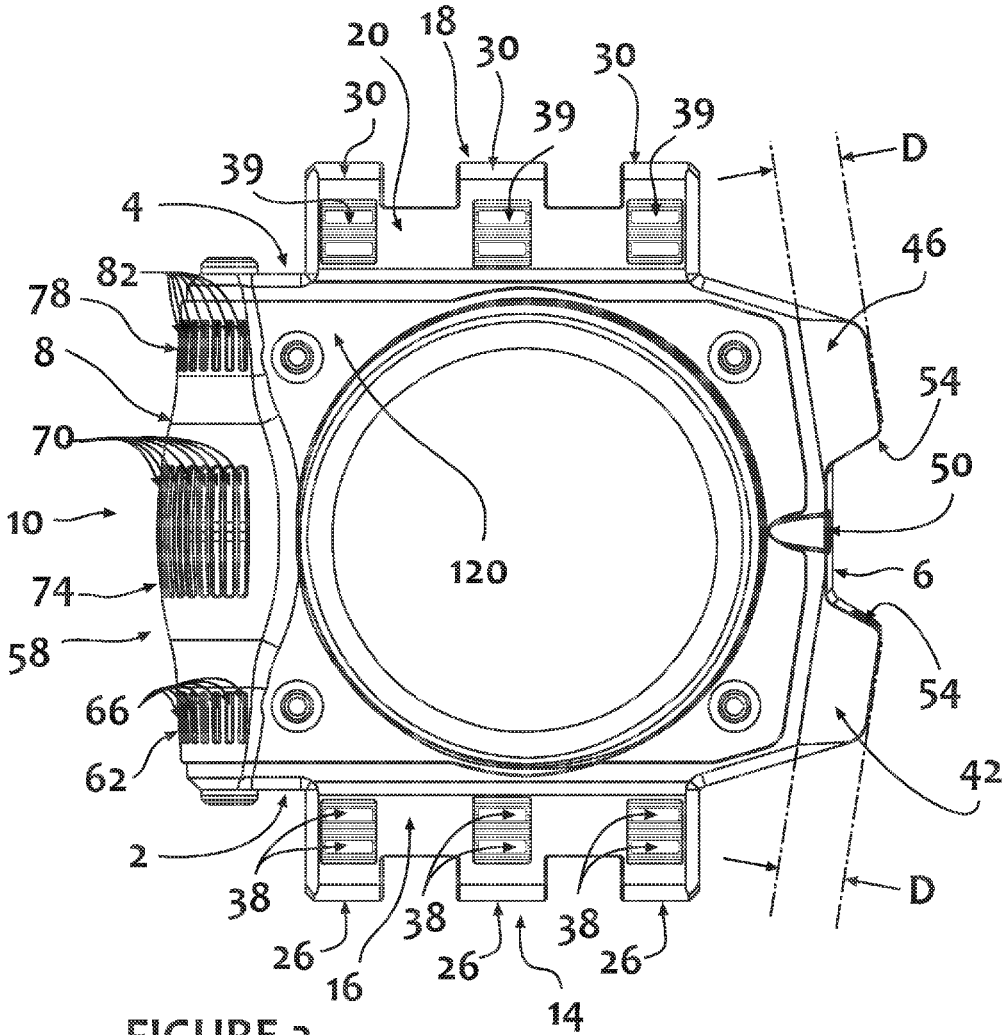
FIG. 3 is a top view of the watch.
Figure 4:
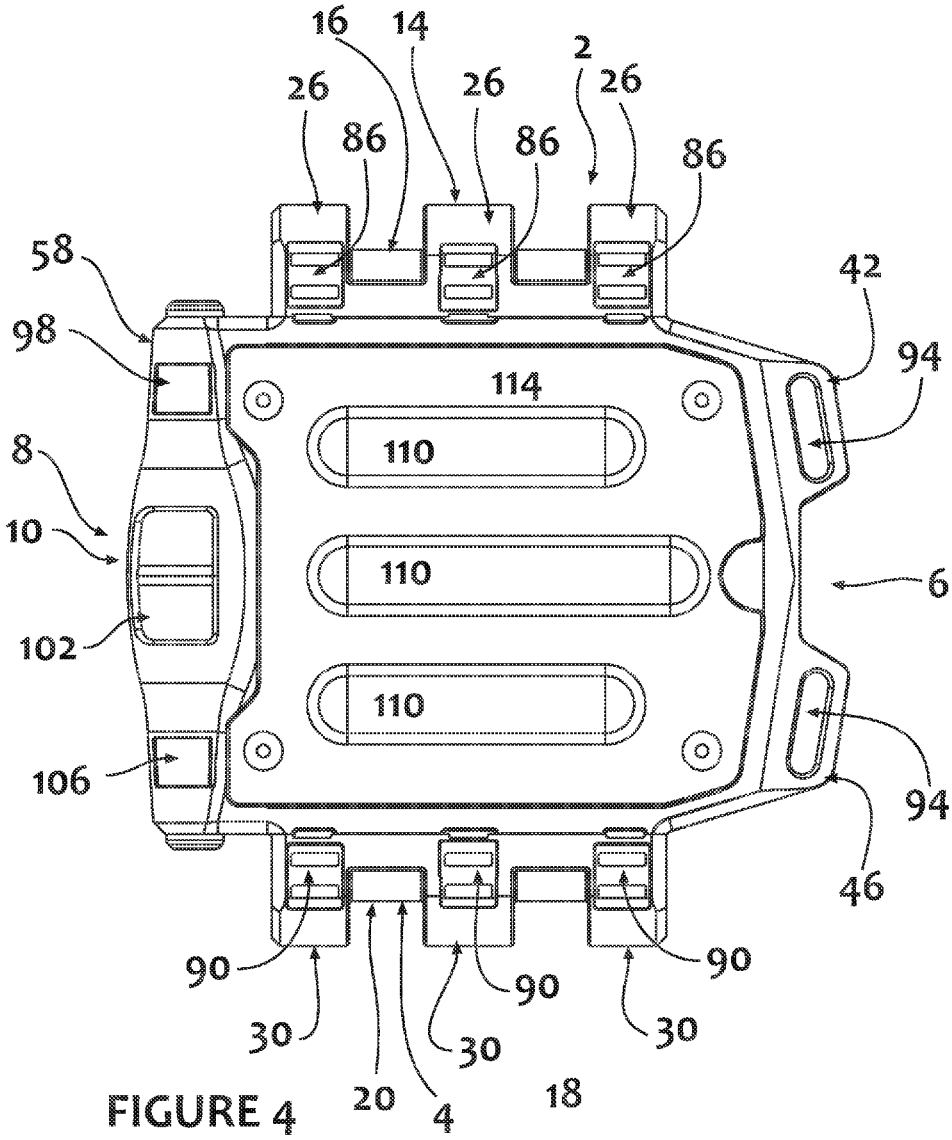
FIG. 4 is a bottom view of the watch.
Figure 6:
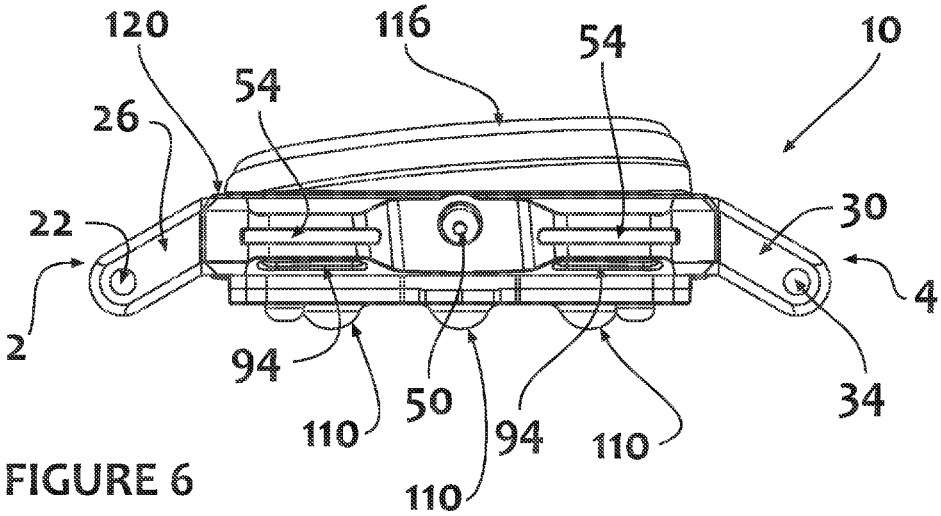
FIG. 6 is another side view of the watch.

FIG. 3 is a top view of the watch 10. FIG. 4 is a bottom view of the watch. FIG. 5 is a side view of the watch 10. FIG. 6 is a crown side view of the watch 10.

The disclosed invention has many advantages. The raised members on the bottom surface of the watch elevate the watchcase slightly keeping the surface of the watch off the wearer's skin. This also allows air to flow between the watchcase and the wearer's skin providing a cooling effect. Second, there are vents through the solid areas of the case, which allow more air to flow in and around the environment of the watch. Raising the watch above the skin of the wearer and piercing the case itself with vent holes allows air to flow between the wearer and the watchcase. This airflow cools the skin especially in hot weather. Airflow also reduces or even eliminates sweating which leads to other discomfort for the wearer. Raising the watch above the skin of the wearer and piercing the case itself with vent holes, thus keeping the area cooler and dryer helps to avoid skin irritation of the wearer Skin irritation is common condition caused by direct contact of stainless steel is a skin irritation, which can be mitigated with this invention. In addition, having smaller vent openings, or sets of several smaller vent openings on the upper side of the watch will prevent debris and other materials from falling into the vent. There is little likelihood of debris falling into the underside vent openings, thus those can be larger, and therefore cost less to manufacture.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A watch comprising:

a watch bezel;

a watch case in communication with the watch bezel, the watch case comprising:

a left side;

a right side;

a crown side;

a non-crown-side;

a bottom surface;

a top surface;

a left watch band connecting member, the left watch band connecting member comprising:

a left base;

a plurality of teeth extending from the left base;

a first left side vent located on the left watch band connecting member, the first left side vent comprising:

a left side first vent opening located on the left watch band connecting member and located generally on the top surface;

a left side second vent opening located on the left watch band connecting member and located generally on the bottom surface and in fluid communication with the left side first vent opening;

a right watch band connecting member, the first right watch band connecting member comprising:

a right base;

a plurality of teeth extending from the right base;

a first right side vent located on the right watch band connecting member, the right side vent comprising:

a right side first vent opening located on the right watch band connecting member and located generally on the top surface;

a right side second vent opening located on the right watch band connecting member and located generally on the bottom surface and in fluid communication with the right side first vent opening;

a first extending member, extending generally parallel to the top surface, and extending from the crown side of the watch case;

a first crown side vent, located in the first extending member, the first crown side vent comprising:

a first vent opening located in the first extending member and generally facing a direction that is parallel to the top surface;

a second vent opening located in the first extending member, and located generally on the bottom surface of the watch, the second vent opening is in fluid communication with the first vent opening;

a generally cylindrically shaped member located on the non-crown side of the watch;

a first vent located on the generally cylindrically shaped member, the first vent comprising:

a first set of vent openings angularly spaced about the generally cylindrically shaped member, where the first set of vent openings are generally on the upper half of the generally cylindrically shaped member;

a first-vent second opening located on the generally cylindrically shaped member and generally facing in the same direction as the bottom surface of the watch, and is in fluid communication with the first set of vent openings.

2. The watch of claim 1, where the left side first vent opening comprises two openings, and the right side first vent opening comprises two openings.

3. The watch of claim 1, where the left watch band connecting member further comprises:

a second left side vent located on the left watch band connecting member, the second left side vent comprising:

a left side third vent opening located on the left watch band connecting member and located generally on the top surface;

a left side fourth vent opening located on the left watch band connecting member and located generally on the bottom surface and in fluid communication with the left side third vent opening;

a third left side vent located on the left watch band connecting member, the third left side vent comprising:

a left side fifth vent opening located on the left watch band connecting member and located generally on the top surface;

a left side sixth vent opening located on the left watch band connecting member and located generally on the bottom surface and in fluid communication with the left side fifth vent opening;

a second right side vent located on the right watch band connecting member, the second right side vent comprising:

a right side third vent opening located on the right watch band connecting member and located generally on the top surface;

a right side fourth vent opening located on the right watch band connecting member and located generally on the bottom surface and in fluid communication with the right side third vent opening;

a third right side vent located on the right watch band connecting member, the third right side vent comprising:

a right side fifth vent opening located on the right watch band connecting member and located generally on the top surface;

a right side sixth vent opening located on the right watch band connecting member and located generally on the bottom surface and in fluid communication with the right side fifth vent opening.

4. The watch of claim 1, where the watch case further comprises:

a second extending member, extending generally parallel to the top surface, and extending from the crown side of the watch case;

a second crown side vent, located in the second extending member, the second crown side vent comprising:

a third vent opening located in the second extending member and generally facing a direction that is parallel to the top surface;

a fourth vent opening located in the second extending member, and located generally on the bottom surface of the watch, the fourth vent opening is in fluid communication with the third vent opening.

5. The watch of claim 1, where the watch case further comprises:

a second vent located on the generally cylindrically shaped member and adjacent to the first vent, the second vent comprising:

a second set of vent openings angularly spaced about the generally cylindrically shaped member, where the second set of vent openings are generally on the upper half of the generally cylindrically shaped member;

a second-vent second opening located on the generally cylindrically shaped member and generally facing in the same direction as the bottom surface of the watch, and is in fluid communication with the second set of vent openings;

a third vent located on the generally cylindrically shaped member and adjacent to the second vent, the third vent comprising:

a third set of vent openings angularly spaced about the generally cylindrically shaped member, where the third set of vent openings are generally on the upper half of the generally cylindrically shaped member;

a third-vent second opening located on the generally cylindrically shaped member and generally facing in the same direction as the bottom surface of the watch, and is in fluid communication with the third set of vent openings.

6. The watch of claim 1, where the watch case further comprises:

at least two raised members located on the bottom surface of the watch.

7. The watch of claim 6, where the at least two raised members are at least twice as long as they are wide, and thus are each an elongated raised member.

8. The watch of claim 7, where each of the elongated raised members is orthogonal to a watch band that attaches to the watch case.

9. The watch of claim 7, where each of the elongated raised members is parallel to a watch band that attaches to the watch case.

10. The watch of claim 6, where the at least two raised members extend about 1.0 mm to about 3.0 mm from the bottom surface of the watch, and the raised members have a length of about 15.0 mm to about 35.0 mm and a width of about 3.0 mm to about 6.0 mm.

11. The watch of claim 1, wherein:

the left side first vent opening has a width of about 2.0 mm to about 5.0 mm and a height of about 0.5 mm to about 2.0 mm;

the right side first vent opening has a width of about 2.0 mm to about 5.0 mm and a height of about 0.5 mm to about 2.0 mm;

the left side second vent opening has width of about 2.0 mm to 5.0 mm and a height of about 1.0 mm to about 6.0 mm; and the right side second vent opening has width of about 2.0 mm to about 5.0 mm and a height of about 1.0 mm to about 6.0 mm.

12. The watch of claim 1, wherein:

the first vent opening has a width of about 5.0 mm to about 12.0 mm;

the second vent opening has a generally rounded rectangular shape, and a height of about 5.0 mm to about 12 mm and a width of about 0.5 mm to about 2.0 mm.

13. The watch of claim 1, wherein:

each vent of the first set of vent openings has a width of about 2.0 mm to about 15.0 mm; and a height of about 0.5 mm to about 6.0 mm;

the first-vent second opening has a width of about 2.0 mm to about 15.0 mm and a height of about 0.5 m to about 6.0 mm.

14. The watch of claim 1, wherein the first extending member extends a distance D from the watch case, where D may range from about 2.0 mm to about 10.0 mm.

* * * * *